US011252802B2

(12) United States Patent
Fischer et al.

(10) Patent No.: US 11,252,802 B2
(45) Date of Patent: Feb. 15, 2022

(54) CIRCUIT ARRANGEMENT FOR A LIGHT SOURCE

(71) Applicant: OSRAM GmbH, Munich (DE)

(72) Inventors: Klaus Fischer, Friedberg (DE); Felix Franck, Munich (DE)

(73) Assignee: OSRAM GmbH, Munich (DE)

( * ) Notice: Subject to any disclaimer, the term of this patent is extended or adjusted under 35 U.S.C. 154(b) by 0 days.

(21) Appl. No.: 17/153,915

(22) Filed: Jan. 21, 2021

(65) Prior Publication Data

US 2021/0235560 A1 Jul. 29, 2021

(30) Foreign Application Priority Data

Jan. 27, 2020 (DE) ..... 10 2020 200 934.1
Jun. 29, 2020 (DE) ..... 10 2020 208 001.1

(51) Int. Cl.
*H05B 45/34* (2020.01)
*H05B 45/46* (2020.01)
*H05B 45/345* (2020.01)

(52) U.S. Cl.
CPC ..... *H05B 45/46* (2020.01); *H05B 45/345* (2020.01)

(58) Field of Classification Search
CPC ..... H05B 45/00; H05B 45/32; H05B 45/345; H05B 45/46; H05B 47/00
See application file for complete search history.

(56) References Cited

U.S. PATENT DOCUMENTS 10,834,792 B2 * 11/2020 Telefus ..... H05B 45/44
2008/0116818 A1 * 5/2008 Shteynberg ..... H05B 45/24 315/192
2012/0306387 A1 12/2012 Ferguson

FOREIGN PATENT DOCUMENTS

DE 102010048362 A1 4/2012

OTHER PUBLICATIONS

German Search Report issued for the corresponding German patent application No. 10 2020 208 001.1, dated Aug. 11, 2021, 5 pages (for informational purposes only).

* cited by examiner

*Primary Examiner* — Jimmy T Vu
(74) *Attorney, Agent, or Firm* — Viering, Jentschura & Partner MBB

(57) ABSTRACT

A circuit arrangement for an LED luminaire comprises a plurality of LED strings, an anode terminal line, a cathode terminal line, a plurality of first switching elements, connected in series into the anode terminal line and subdivided into individual line sections, and a plurality of second switching elements, connected in series into the cathode terminal line and subdivided into individual line sections. Each of the LED strings may be connected to the anode terminal line via a first switching element and/or the second switching elements. Each of the first switching elements may be configured to feed an operating current to an LED string, to electrically connect line sections if the current flowing through the LED string exceeds a predetermined value, and to electrically isolate line sections if the current flowing through the LED string falls below a predetermined value.

18 Claims, 3 Drawing Sheets

CIRCUIT ARRANGEMENT FOR A LIGHT SOURCE

CROSS-REFERENCE TO RELATED APPLICATIONS

This application claims priority to German Application 10 2020 200 934.1, which was filed on Jan. 27, 2020, and to German Application 10 2020 208 001.1, which was filed on Jun. 29, 2020, the contents of each of which are hereby incorporated by reference herein.

TECHNICAL FIELD

The present disclosure relates to a circuit arrangement for a light source including a plurality of light-emitting diodes (LEDs).

BACKGROUND

One or a plurality of LED modules for generating light is/are generally integrated in LED luminaires. The LED modules used for this purpose are often constructed in accordance with desired operating data in such a way that LEDs are interconnected in series in so-called strings and a plurality of such strings are connected in parallel on a module. By way of example, such an LED module can include 40 LEDs, wherein four strings each including ten LEDs connected in series are connected in parallel.

Constant-current drivers are generally used for the operation of such LED strings connected in parallel, said constant-current drivers supplying an approximately constant current independently of the operating voltage of the load. Said current corresponds to the sum of the operating currents that the individual LED strings require for their function.

Problems can occur, however, if an LED string fails during such constant-current operation. In this case, the LED string normally acquires high impedance. This high-impedance state of an LED string can arise for example by virtue of one or more LEDs being removed as a result of mechanical action or by virtue of electrical overloads resulting in the failure of LEDs, which drastically reduce the electrical conductivity thereof, for example as a result of evaporation of the bond wire contacting the LED chip.

In this case, the total current supplied by the driver is distributed among a smaller number of remaining LED strings, as a result of which the latter may be overloaded. The safety of the luminaire may be jeopardized as a result. The overloading may also result in the failure of further LED strings, whereby this effect is additionally intensified.

In the worst case, the safety of the LED module may be adversely affected by LED strings that are overloaded in this way. In this regard, gases or material may be released, for example, or overheating at points or general overheating may jeopardize the safety provided by an LED luminaire vis a vis electric shock.

BRIEF SUMMARY OF FIGURES

Further features and expediencies of the disclosure will become apparent from the description of exemplary aspects of the disclosure with reference to the accompanying drawings.

DETAILED DESCRIPTION

Figure 1:
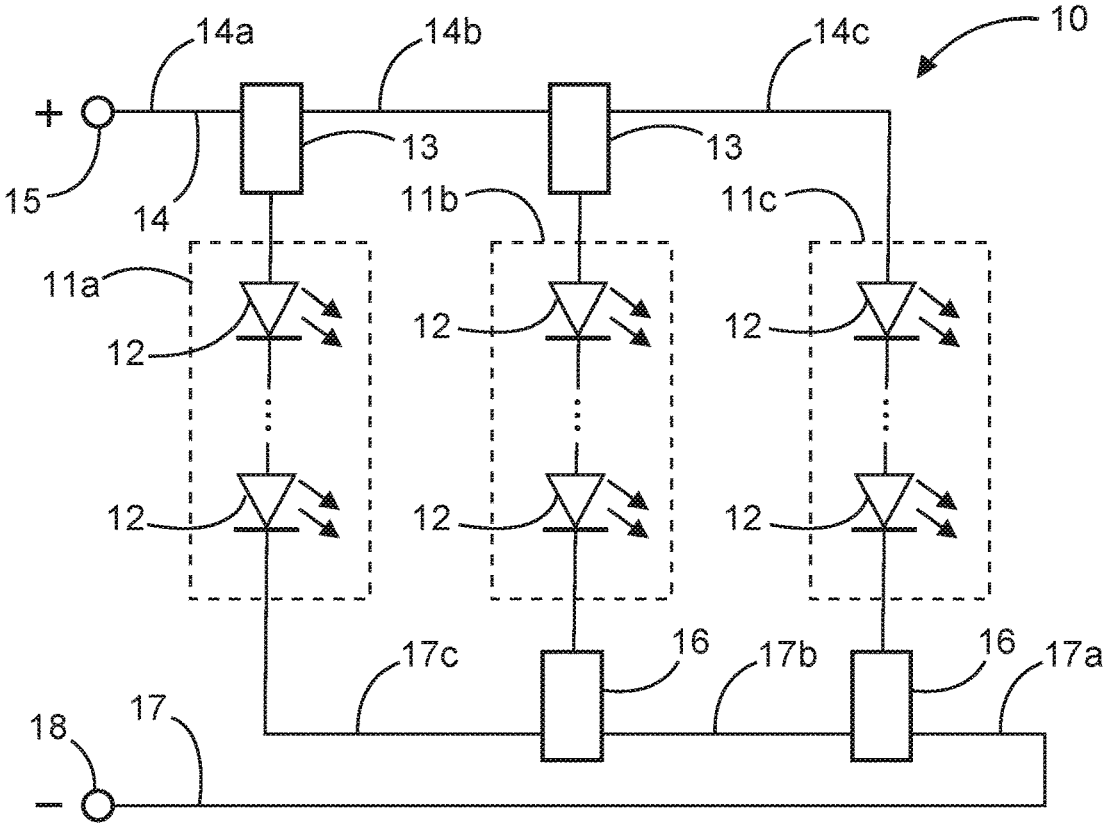
FIG. 1 shows a schematic circuit diagram of a circuit arrangement in accordance with one aspect of the disclosure of the present disclosure.

This safety risk can be avoided by using constant-voltage drivers in LED luminaires. In this case, the driver outputs an approximately constant voltage independently of the current supplied. The current supplied results as the sum of the operating currents drawn by the LED strings at this voltage. If one of the LED strings connected in parallel fails, the total current of the driver decreases. On the other hand, the current and the power consumption of the remaining LED strings remain virtually unchanged. What is disadvantageous in this case is that a dedicated current limiting or control mechanism has to be provided for each LED string. It is therefore an object of the present disclosure to provide a circuit arrangement for an LED luminaire such that, upon failure of a single LED string or a plurality of LED strings, the LED luminaire is protected against overloading of one or more still functional LED strings.

The object is achieved by means of a circuit arrangement according to Claim 1, an LED module according to Claim 13 and respectively by means of an LED luminaire according to Claim 14. Developments of the disclosure are respectively specified in the dependent claims. In this case, each device can also be developed by the features of other devices given below or presented in the dependent claims, or vice versa.

The circuit arrangement according to the disclosure for an LED luminaire includes a plurality of LED strings, each of which includes one light-emitting diode or a plurality of light-emitting diodes connected in series with one another, an anode terminal line for connecting the plurality of LED strings to an anode terminal, a cathode terminal line for connecting the plurality of LED strings to a cathode terminal, a plurality of first switching elements, which are connected in series into the anode terminal line and subdivided into individual line sections, and a plurality of second switching elements, which are connected in series into the cathode terminal line and subdivided into individual line sections. Each of the LED strings is connected to the anode terminal line via one of the first switching elements and/or is connected to the anode terminal line via one of the second switching elements. Each of the first switching elements is configured to feed an operating current to the LED string connected to it, to electrically connect to one another the line sections connected to it if the current flowing through the LED string connected to it exceeds a predetermined value, and to electrically isolate from one another the line sections connected to it if the current flowing through the LED string connected to it falls below a predetermined value.

Such a circuit arrangement makes it possible, for example, to achieve the effect that in the event of the failure of one LED string, the lines supplying the circuit arrangement are interrupted in order to avoid overloading of another LED string.

In one advantageous development, the LED strings are connected to the anode terminal line in a first order as viewed from the anode terminal, and are connected to the cathode terminal line in a second order, which is the inverse of the first order, as viewed from the cathode terminal.

As a result, it is possible for example to ensure that in the event of the failure of one LED string, no closed electrical circuit remains between a driver included in the luminaire and any of the other LED strings. As a result, it is possible for example to prevent a situation in which one of the other LED strings is overloaded and thus the safety of the luminaire is jeopardized or the overloaded LED string itself fails.

In one advantageous aspect of the disclosure, the LED string which is connected to the anode terminal line the furthest away from the anode terminal is connected to the anode terminal line directly and not via a first switching element, and/or the LED string which is connected to the cathode terminal line the furthest away from the cathode terminal is connected to the cathode terminal line directly and not via a second switching element, and/or each LED string which is neither connected to the anode terminal line the furthest away from the anode terminal nor connected to the cathode terminal line furthest away from the cathode terminal is both connected to the anode terminal line via a first switching element and connected to the cathode terminal line via a second switching element.

As a result, it is possible for example to prevent switching elements from being arranged at locations at which they are not required.

In one advantageous aspect of the disclosure, each of the first and second switching elements contains a bipolar transistor. In this case, the bipolar transistor of each first switching element is preferably a pnp transistor and/or the bipolar transistor of each second switching element is preferably an npn transistor.

As a result, for example, the switching function can be realized by way of semiconductor elements that are readily available at low cost.

In one advantageous aspect of the disclosure, in the bipolar transistor of the first switching element an emitter is connected to the line section of the anode terminal line which leads from the bipolar transistor in the direction towards the anode terminal, a collector is connected to the line section of the anode terminal line which leads from the bipolar transistor in a direction away from the anode terminal, and a base is connected to the corresponding LED string, and/or in the bipolar transistor of the second switching element an emitter is connected to the line section of the cathode terminal line which leads from the bipolar transistor in the direction towards the cathode terminal, a collector is connected to the line section of the cathode terminal line which leads from the bipolar transistor in a direction away from the cathode terminal, and a base is connected to the corresponding LED string.

As a result, what can be achieved, for example, is that the bipolar transistor, via its base-emitter path, feeds an operating current to the LED string and, during operation of the LED string, electrically connects to one another the line sections connected to it and, upon failure of the LED string, electrically isolates from one another the line sections connected to it.

In one advantageous aspect of the disclosure, a diode is connected in series with an LED string which is connected to the anode terminal line or the cathode terminal line without the interposition of a first or second switching element. The diode is preferably formed as a base-emitter path of a bipolar transistor whose collector is left unconnected.

As a result, it is possible for example to achieve a voltage balancing of the base-emitter voltages of the bipolar transistors in the LED strings that do not have a first or respectively a second switching element.

In one advantageous aspect of the disclosure, each of the first and second switching elements includes a field effect transistor. In this case, the field effect transistor of each first switching element is preferably a p-channel MOSFET and/or the field effect transistor of each second switching element is preferably an n-channel MOSFET.

As a result, for example, the switching function can be realized by way of semiconductor elements that are readily available at low cost.

In one advantageous aspect of the disclosure, in the field effect transistor of the first switching element a source is connected to the line section of the anode terminal line which leads from the field effect transistor in the direction towards the anode terminal, a drain is connected to the line section of the anode terminal line which leads from the field effect transistor in a direction away from the anode terminal, a gate is connected to the corresponding LED string and wherein furthermore a Zener diode is connected to the gate via its anode and to the source via its cathode and/or one light-emitting diode or a plurality of light-emitting diodes connected in series with one another is/are connected to the gate at its/their cathode side and to the source at its/their anode side, and/or in the field effect transistor of the second switching element a source is connected to the line section of the cathode terminal line which leads from the field effect transistor in the direction towards the cathode terminal, a drain is connected to the line section of the cathode terminal line which leads from the field effect transistor in a direction away from the cathode terminal, a gate is connected to the corresponding LED string and wherein furthermore a Zener diode is connected to the gate via its cathode and to the source via its anode and/or one light-emitting diode or a plurality of light-emitting diodes connected in series with one another is/are connected to the gate at its/their anode side and to the source at its/their cathode side.

As a result, what can be achieved, for example, is that an operating current is fed to the LED string via the Zener diode and/or the light-emitting diode or series circuit formed by light-emitting diodes that is connected in antiparallel with said Zener diode, and that the field effect transistor, during operation of the LED string, electrically connects to one another the line sections connected to it and, upon failure of the LED string, electrically isolates from one another the line sections connected to it.

In one advantageous aspect of the disclosure, a Zener diode is connected in series between the LED string which is connected to the cathode terminal line without the interposition of a second switching element and the cathode terminal line, and/or a Zener diode is connected in series between the LED string which is connected to the anode terminal line without the interposition of a first switching element and the anode terminal line, and/or a Zener voltage of each Zener diode is a few tenths of a volt greater than a forward voltage or sum of the forward voltages of the light-emitting diode or the plurality of light-emitting diodes connected in series with one another that is/are connected in antiparallel with the Zener diode.

As a result, it is possible for example to achieve a voltage balancing in the LED strings that do not have a first or respectively a second switching element, or it is possible for example to achieve the effect that during normal operation no operating current flows through the Zener diodes and the efficiency of the circuit arrangement is thus improved.

In one advantageous aspect of the disclosure, in the bipolar transistor of the first switching element an emitter is connected to the line section of the anode terminal line which leads from the bipolar transistor in the direction towards the anode terminal, a collector is connected to the line section of the anode terminal line which leads from the bipolar transistor in a direction away from the anode terminal, a base is connected to the corresponding LED string via a resistor, and a diode is connected in the forward direction between the anode terminal line and the corresponding LED string, and/or in the bipolar transistor of the second switching element an emitter is connected to the line section of the cathode terminal line which leads from the bipolar transistor in the direction towards the cathode terminal, a collector is connected to the line section of the cathode terminal line which leads from the bipolar transistor in a direction away from the cathode terminal, a base is connected to the corresponding LED string via a resistor, and a diode is connected in the forward direction between the cathode side of the corresponding LED string and the cathode terminal line.

As a result, what can be achieved, for example, is that an operating current is fed to the LED string via the diodes and that the bipolar transistor during operation of the LED string, electrically connects to one another the line sections connected to it and, upon failure of the LED string, electrically isolates from one another the line sections connected to it.

In one advantageous aspect of the disclosure, a diode is connected in the forward direction between the LED string which is connected to the cathode terminal line without the interposition of a second switching element and the cathode terminal line, and/or a diode is connected in the forward direction between the LED string which is connected to the anode terminal line without the interposition of a first switching element and the anode terminal line.

As a result, it is possible for example to achieve a voltage balancing in the LED strings that do not have a first or respectively a second switching element.

In one advantageous aspect of the disclosure, the bipolar transistors are embodied as Darlington transistors and in each case two diodes are connected in series between an LED string and the anode terminal line and between the LED string and the cathode terminal line.

As a result, for example, a current gain of the bipolar transistors can be increased, whereby a lower base current is required for attaining the on state.

The LED module according to the disclosure includes at least one circuit arrangement according to the disclosure.

With such an LED module, it is possible for example to achieve the effects of the circuit arrangement according to the disclosure for an LED module.

The LED luminaire according to the disclosure includes a circuit arrangement according to the disclosure and/or an LED module according to the disclosure and a driver, connected to the anode terminal and the cathode terminal of the circuit arrangement.

With such an LED luminaire, it is possible for example to achieve the effects of the circuit arrangement according to the disclosure for an LED luminaire.

In one advantageous development, the driver is a constant-current driver.

As a result, it is possible for example to realize particularly simple operation of LED strings connected in parallel.

Aspects of the disclosure of the present disclosure are described below with reference to the accompanying drawings.

FIG. 1 shows a schematic circuit diagram of a circuit arrangement 10. The circuit arrangement can be realized on an LED module that is insertable into an LED luminaire, or directly in the LED luminaire.

The circuit arrangement 10 includes a plurality of LED strings, 11*a*, 11*b*, 11*c* formed in each case from a plurality of light-emitting diodes 12 connected in series. In this figure, as a non-limiting example, three LED strings 11*a*, 11*b*, 11*c* are connected in parallel with one another. The number of light-emitting diodes per string and also the number of strings connected in parallel can be chosen as desired. However, it is advantageous if all the LED strings of a circuit arrangement under consideration are equipped with light-emitting diodes of an identical type, and if the number of light-emitting diodes per string within the same circuit arrangement is identical in each case. This ensures that the operating voltage of each LED string within the same circuit arrangement is virtually identical.

The anode sides of the LED strings 11*a*, 11*b*, 11*c* are connected to an anode terminal line 14 via first switching elements 13. One end of the anode terminal line 14 is connected to an anode terminal 15 provided for connecting a positive pole of a driver (not shown in the figure). In this case, a constant-current driver is preferably used as the driver.

Likewise, the cathode sides of the LED strings are connected to a cathode terminal line 17 via second switching elements 16. One end of the cathode terminal line 17 is connected to a cathode terminal 18 provided for connecting a negative pole of the driver.

In this case, the first and second switching elements 13, 16 are connected in series into the anode terminal line 14 and into the cathode terminal line 17 and divide them into line sections 14*a*, 14*b*, 14*c* and 17*a*, 17*b*, 17*c* respectively.

In this case, the first and second switching elements 13, 16 fulfil a double function: firstly, they relay a voltage fed in via the anode and cathode terminals 13, 16, respectively, to the respective LED string 11*a*, 11*b*, 11*c*, such that an operating current can flow through the latter. Secondly, they connect the line sections 14*a*, 14*b*, 14*c* and 17*a*, 17*b*, 17*c* respectively, to one another when the corresponding LED strings 11*a*, 11*b*, 11*c* are in operation, i.e. are carrying current. If one of the LED strings is not carrying current or the current flowing through the LED string falls below a predetermined limit value, the switching elements disconnect the adjacent line sections from one another.

The LED strings are connected to the anode terminal line 14 and to the cathode terminal line 17 respectively in an opposite order. In the example illustrated in FIG. 1, the LED string 11*a*, the LED string 11*b* and the LED string 11*c* are connected to the anode terminal line 14 in this order as viewed from the anode terminal 15. By contrast, the LED string 11*c*, the LED string 11*b* and the LED string 11*a* are connected to the cathode terminal line 17 in this order as viewed from the cathode terminal 18, i.e. in an order opposite to that in which they are connected to the anode terminal line 14.

The LED string 11*a* which is connected to the anode terminal line 14 the closest to the anode terminal 15 and is thus connected to the cathode terminal line 17 the furthest away from the cathode terminal 18 is connected to the cathode terminal line 17 directly and not via a second switching element 16. Likewise, the LED string 11*c* which is connected to the cathode terminal line 7 the closest to the cathode terminal 18 and is thus connected to the anode terminal line 14 the furthest away from the anode terminal 15 is connected to the anode terminal line 14 directly and not via a first switching element 13. The remaining LED strings (only the LED string 11*b* in the example shown in FIG. 1) are connected both to the anode terminal line 14 via a first switching element 13 and to the cathode terminal line 17 via a second switching element 16. Consequently, each LED string is connected between the two terminal lines 14, 17 via at least one switching element.

In the case of the arrangement described above, none of the LED strings 11*a*, 11*b*, 11*c* is connected both to the anode terminal 15 and to the cathode terminal 18 directly or via a corresponding switching element 13, 16. At least one first or second switching element 13, 16 of another LED string 11*a*, 11*b*, 11*c* lies between each LED string 11*a*, 11*b*, 11*c* and at least the anode terminal 15 or the cathode terminal 18.

The manner of operation of the circuit arrangement 10 illustrated in FIG. 1 in the event of the failure of one of the LED strings 11*a*, 11*b*, 11*c* is explained below:

If the LED string 11*a* fails, the assigned first switching element 13 electrically isolates the line sections 14*a* and 14*b* from one another. Even if the two remaining LED strings 11*b* and 11*c* remain connected to the cathode terminal 18, neither of them is connected to the anode terminal 15 anymore.

If the LED string 11*b* fails, the assigned first switching element 13 electrically isolates the line sections 14*b* and 14*c* from one another, and the assigned second switching element 16 electrically isolates the line sections 17*b* and 17*c* from one another. Consequently, the remaining LED string 11*a* is still connected only to the anode terminal 15, but is no longer connected to the cathode terminal 18. The remaining LED string 11*c* is still connected only to the cathode terminal 18, but is no longer connected to the anode terminal 15.

If the LED string 11*c* fails, the assigned second switching element 16 electrically isolates the line sections 17*a* and 17*b* from one another. Even if the two remaining LED strings 11*a* and 11*b* remain connected to the anode terminal 15, neither of them is connected to the cathode terminal 18 anymore.

Expressed in general terms, what is achieved by the circuit arrangement 10 described above is that the LED strings connected to the anode terminal line 14 behind the failed LED string as viewed from the anode terminal 15 (to the right of the failed LED string in FIG. 1) are no longer connected to the anode terminal 15, and that the LED strings connected to the cathode terminal line 17 behind the failed LED string as viewed from the cathode terminal 18 (to the left of the failed LED string in FIG. 1) are no longer connected to the cathode terminal 18.

The circuit arrangement 10 thus achieves the effect that in the event of the failure of one LED string, none of the remaining LED strings is connected both to the anode terminal 15 and to the cathode terminal 18. Consequently, none of the remaining LED strings forms any longer a closed electrical circuit with the driver connected to the anode terminal and to the cathode terminal. Therefore, in the event of the failure of one LED string, none of the remaining LED strings can be overloaded. This prevents a situation in which the safety of the luminaire is jeopardized or one of the remaining LED strings itself fails. It is thus not necessary to provide a dedicated current limiting mechanism for each individual LED string. In this case, it is unimportant which or how many of the LED strings fail since the electrical circuit is interrupted through the remaining LED strings and the driver in any case.

Figure 2:
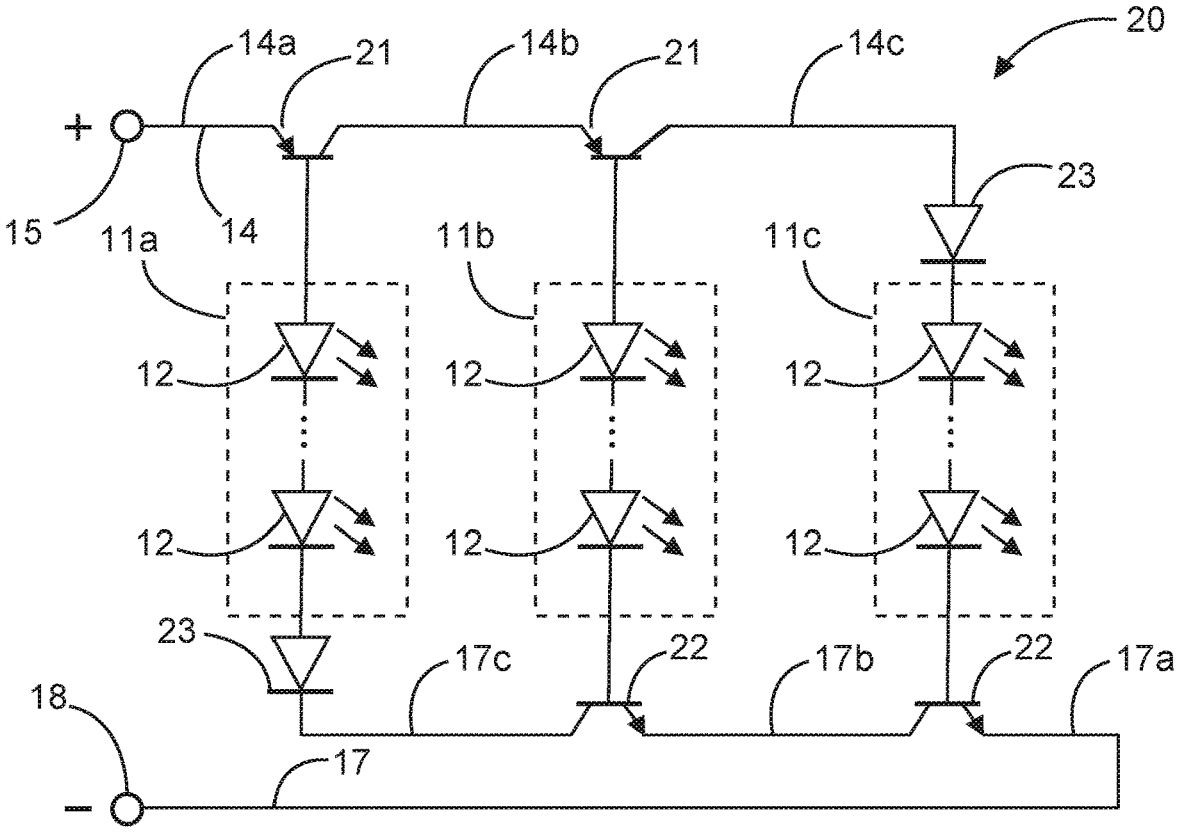
FIG. 2 shows a schematic circuit diagram of a circuit arrangement in accordance with a further aspect of the disclosure of the present disclosure.

The function of the first and second switching elements 13, 16 can be realized in various ways. A first example of this is illustrated in FIG. 2. In this case, elements that correspond to those shown in FIG. 1 are identified by the same reference signs and will not be described again.

FIG. 2 shows a circuit arrangement 20 in which each of the first and second switching elements 13, 16 includes a bipolar transistor 21, 22. In this case, the bipolar transistors of the first switching elements 3 are formed as pnp transistors 21 and the bipolar transistors of the second switching elements 16 are formed as npn transistors 22.

An emitter of each pnp transistor 21 is connected to that line section 14*a*, 14*b* of the anode terminal line 14 which leads from the transistor 21 in the direction towards the anode terminal 15. A collector of each pnp transistor 21 is connected to that line section 14*b*, 14*c* of the anode terminal line 14 which leads from the transistor 21 in a direction away from the anode terminal 15. A base of each pnp transistor 21 is connected to the anode side of the corresponding LED string 11*a*, 11*b*.

An emitter of each npn transistor 22 is connected to that line section 17*a*, 17*b* of the cathode terminal line 17 which leads from the transistor 22 in the direction towards the cathode terminal 18. A collector of each npn transistor 22 is connected to that line section 17*b*, 17*c* of the cathode terminal line 17 which leads from the transistor 22 in a direction away from the cathode terminal 18. A base of each npn transistor 22 is connected to the cathode side of the corresponding LED string 11*b*, 11*c*.

In each LED string an additional voltage drop is produced by the base-emitter voltages of the first or respectively the second switching element 13, 16. As a result, in the strings containing only one of the two switching elements 13, 16, a different voltage distribution would arise in comparison with in the strings containing both switching elements 13, 16. In order to compensate for the missing base-emitter voltage there, a respective diode 23 is connected in series with each of the LED strings 11*a*, 11*c* that do not have a first or respectively a second switching element 13, 16. A forward voltage of the diodes 23 is chosen such that it corresponds to the saturation voltage of the base-emitter diode of the corresponding transistor 21, 22 to the greatest possible extent. That can be achieved, for example, by the diodes being formed by the base-emitter path of corresponding transistors whose collectors are left unconnected (open-collector operation).

During normal operation of the circuit arrangement 20, through each LED string 11*a*, 11*b*, 11*c* an operating current flows through the base-emitter path of the pnp transistor 21 (or the diode 23 provided instead), the series circuit formed by the light-emitting diodes 12 and the base-emitter path of the npn transistor 22 (or the diode 23 provided instead). As a base current of the respective transistors 21, 22 said operating current ensures that the collector-emitter paths of the corresponding transistors 21, 22 become conducting and thus transfer the operating currents for the LED strings connected to the corresponding line downstream of them.

If one LED string fails and acquires high impedance, an operating current no longer flows through it. Consequently, a base current also does not flow through the transistor bases connected to this string. Therefore, these transistors become non-conducting and electrically isolate from one another the line sections connected to them. As described above with reference to FIG. 1, as a result the supply of current to the other LED strings is interrupted because none of the remaining LED strings anymore is connected both to the anode terminal 15 and to the cathode terminal 18. It is thus possible to achieve the same effects with the circuit arrangement 20 as with the circuit arrangement 10.

In the example shown in FIG. 2, the transistors 21, 22 perform both the function of feeding an operating current to the LED strings 11*a*, 11*b*, 11*c* and the function of connecting or isolating the line sections 14*a*, 14*b*, 14*c* and 17*a*, 17*b*, 17*c*, respectively, depending on the operating state of the LED string connected to them.

These two functions can also be separated, however, by dedicated components for supplying and monitoring current being provided and the switching elements then being turned on or opened depending on a detected current.

Figure 3A:
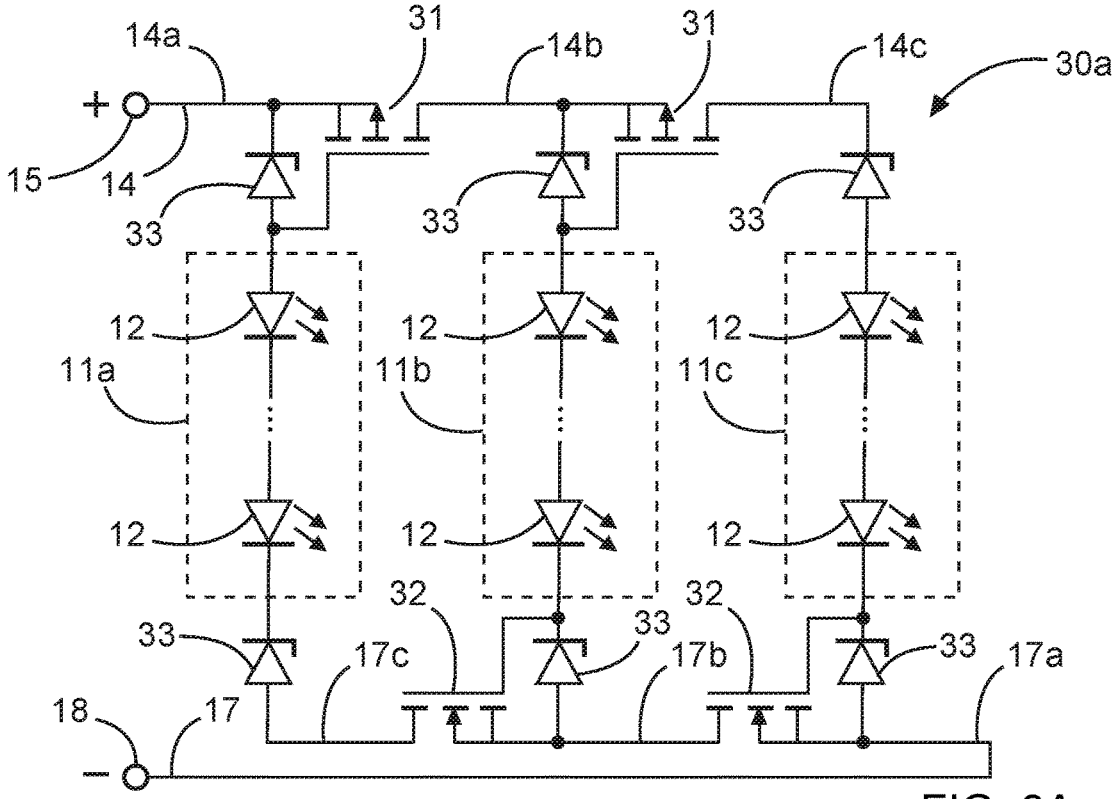
FIG. 3A shows a schematic circuit diagram of a circuit arrangement in accordance with a further aspect of the disclosure of the present disclosure.

One example of such a set-up is illustrated in FIG. 3A. In this case, elements corresponding to those shown in FIG. 1 are identified by the same reference signs and will not be described again.

In accordance with FIG. 3A, each of the first and second switching elements includes a field effect transistor 31, 32. In this case, the field effect transistors of the first switching elements 13 are formed as p-channel MOSFETs 31 and the field effect transistors of the second switching elements 16 are formed as n-channel MOSFETs 32.

A source of each p-channel MOSFET 31 is connected to that line section 14*a*, 14*b* of the anode terminal line 14 which leads from the MOSFET 31 in the direction towards the anode terminal 15. A drain of each p-channel MOSFET 31 is connected to that line section 14*b*, 14*c* of the anode terminal line 14 which leads from the MOSFET 31 in a direction away from the anode terminal 15. A gate of each p-channel MOSFET 31 is connected to the anode side of the corresponding LED string 11*a*, 11*b*. A Zener diode 33 is connected between gate and source of each p-channel MOSFET 31 such that its anode is connected to the gate and its cathode is connected to the source.

A source of each n-channel MOSFET 32 is connected to that line section 17*a*, 17*b* of the cathode terminal line 17 which leads from the MOSFET 32 in the direction towards the cathode terminal 18. A drain of each n-channel MOSFET 32 is connected to that line section 17*b*, 17*c* of the cathode terminal line 17 which leads from the MOSFET 32 in a direction away from the cathode terminal 18. A gate of each n-channel MOSFET 32 is connected to the cathode side of the corresponding LED string 11*b*, 11*c*. A Zener diode 33 is connected between gate and source of each n-channel MOSFET 32 such that its cathode is connected to the gate and its anode is connected to the source.

For voltage balancing, a respective Zener diode 33 is also connected in the reverse direction between the cathode side of the LED string 11*a* and the cathode terminal line 17 and between the anode side of the LED string 11*c* and the anode terminal line 14.

Consequently, each LED string 11*a*, 11*b*, 11*c* is connected in series with two Zener diodes 33, arranged in the reverse direction, between the anode terminal line 14 and the cathode terminal line 17. In this case, the Zener diodes 33 perform the function of feeding current to the LED strings 11*a*, 11*b*, 11*c*. However, they also serve for monitoring the operating current of the LED strings 11*a*, 11*b*, 11*c* by virtue of their generating a gate-source voltage for switching on the associated field effect transistors that is dependent on the operating current of the LED string connected to the associated gate.

During normal operation of the circuit arrangement 30*a*, an operating current flows through each LED string 11*a*, 11*b*, 11*c*. Said operating current generates at the Zener diodes 33 a voltage drop corresponding to a Zener voltage of the Zener diodes 33. Said Zener voltage is chosen such that the gate-source voltage at the corresponding transistor is high enough to reliably turn on the transistor, such that the latter can transfer the operating currents for the LED strings connected to the corresponding line downstream of said transistor.

If one LED string fails and acquires high impedance, an operating current no longer flows through it. Consequently, the Zener voltage is also no longer dropped across the assigned Zener diodes. As a result, the gate-source voltage at the corresponding transistors becomes so low that the latter turn off and isolate from one another the line sections connected to them. As described above with reference to FIG. 1, as a result the supply of current to the other LED strings is interrupted because none of the remaining LED strings anymore is connected both to the anode terminal 15 and to the cathode terminal 18. It is thus possible to achieve the same effects with the circuit arrangement 30*a* as with the circuit arrangement 10.

Figure 3B:
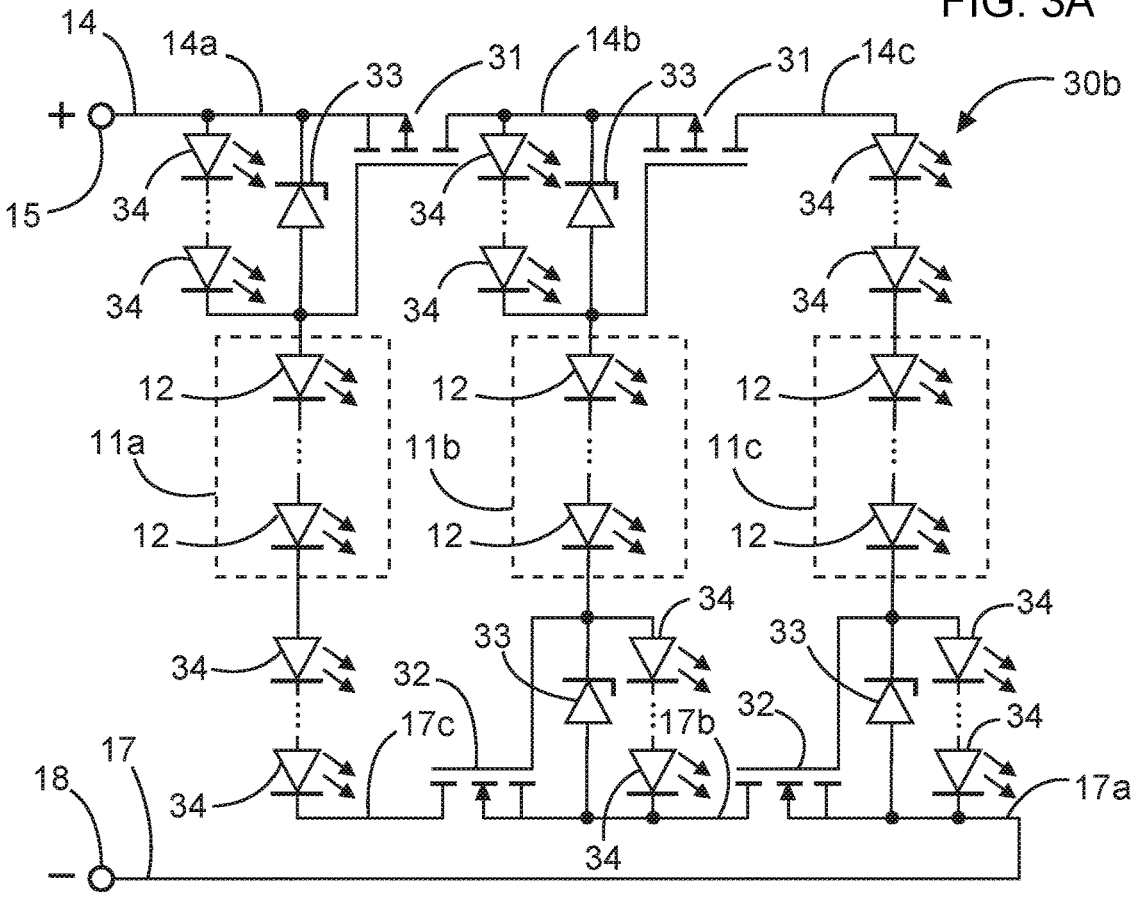
FIG. 3B shows a schematic circuit diagram of a modification of the circuit arrangement shown in FIG. 3A

FIG. 3B shows a modification of the circuit arrangement shown in FIG. 3A. In the case of this circuit arrangement 30*b*, in antiparallel with each Zener diode 33 one light-emitting diode 34 or a plurality of light-emitting diodes 34 connected in series with one another is/are connected between gate and source of the respective transistor. Two light-emitting diodes 34 connected in series are shown as an example in the figure. Here in each case the anode side of the series circuit of light-emitting diodes 34 is connected to the cathode of the Zener diode 33 and the cathode side of the series circuit of light-emitting diodes 34 is connected to the anode of the Zener diode 33. The Zener voltage of each Zener diode 33 is chosen to be a few tenths of a volt greater than a forward voltage or sum of the forward voltages of the series circuit of light-emitting diodes 34 that is connected in antiparallel with it. At the locations at which an LED string is connected to the anode or cathode terminal line without a switching element, the Zener diode 33 can be omitted and just the series circuit of light-emitting diodes 34 can be provided.

Consequently, during normal operation, the operating current of an LED string does not flow through the Zener diode 33, but rather through the series circuit of light-emitting diodes 34 that is connected in antiparallel with it. It is true here that on account of the approximate correspondence between the Zener voltage and the sum of the forward voltages, the electrical power consumed is approximately the same as in the case where the operating current would flow through the Zener diode 33. However, this power is converted into additional light by the series circuit of light-emitting diodes 34. In other words, it is utilized for the operation of the LED module or the LED luminaire and is not lost as power loss in the form of heat. During normal operation the circuit arrangement 30*b* is thus more efficient than the circuit arrangement 30*a*.

If one LED string fails and acquires high impedance, an operating current also no longer flows through the assigned series circuit of light-emitting diodes 34, and hence a forward voltage is also no longer dropped across the latter. Consequently, in the case of the circuit arrangement 30*b*, too, the gate-source voltage at the corresponding transistors becomes so low that the latter turn off and isolate from one another the line sections connected to them. Thus, in the event of the failure of an LED string, the circuit arrangement 30*b* achieves the same effect as the circuit arrangement 30*a*.

Both in the normal case and in the event of the failure of an LED string, the Zener diode thus has no function and could therefore be omitted. However, it increases the protective effect of the circuit arrangement for the case where a light-emitting diode 34 from the series circuit of light-emitting diodes 34 fails. In this case, the gate-source voltage at the corresponding transistors is not decreased, but rather on the contrary can also be increased (particularly in the absence of a Zener diode). The overvoltage occurring would switch on the affected field effect transistor to an even greater extent (make it have even lower impedance). The remaining LED strings would therefore not be protected against overloading through interruption of the electrical circuit. The overvoltage at the gate can even result in destruction of the field effect transistor, such that the latter acquires permanently low impedance. Consequently, the circuit arrangement shown has a higher protective effect than in the case where the Zener diodes would be omitted.

Figure 4:
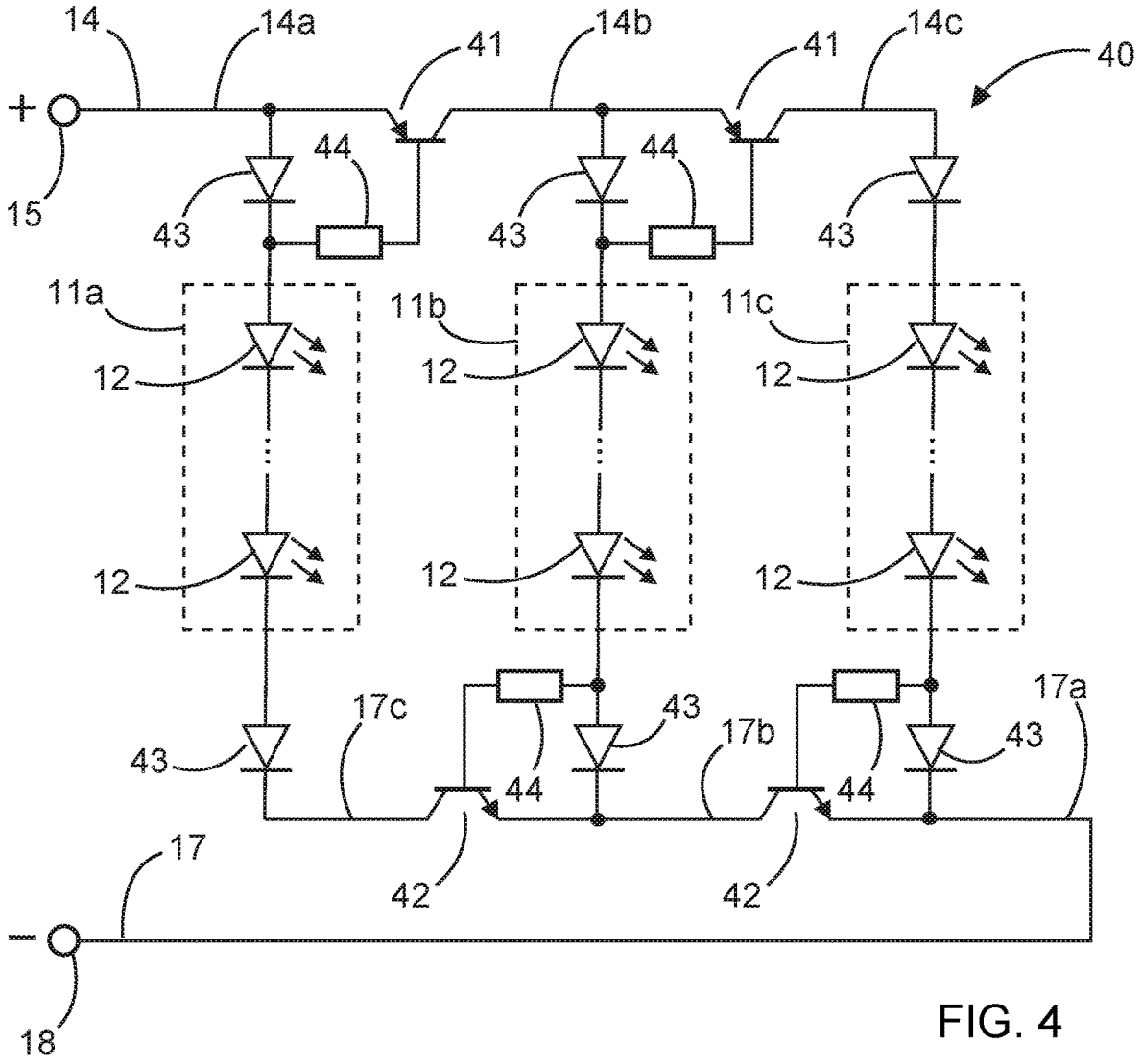
FIG. 4 shows a schematic circuit diagram of a circuit arrangement in accordance with a further aspect of the disclosure of the present disclosure.

A further example of a circuit set-up in which the functions of feeding an operating current to the LED strings and the connecting or isolating of the line sections are realized by separate elements is illustrated in FIG. 4. In this case, elements corresponding to those shown in FIG. 1 are identified by the same reference signs and will not be described again.

FIG. 4 shows a circuit arrangement 40 in which each of the first and second switching elements includes a bipolar transistor 41, 42. As in the case of the circuit arrangement 20 shown in FIG. 2, the bipolar transistors of the first switching elements 13 are formed as pnp transistors 41 and the bipolar transistors of the second switching elements 16 are formed as npn transistors 42. The interconnection of the emitter-collector and respectively the collector-emitter paths of the bipolar transistors 41, 42 is also similar to that in the case of the circuit arrangement 20.

An emitter of each pnp transistor 41 is connected to that line section 14*a*, 14*b* of the anode terminal line 14 which leads from the transistor 41 in the direction towards the anode terminal 15. A collector of each pnp transistor 41 is connected to that line section 14*b*, 14*c* of the anode terminal line 14 which leads from the transistor 41 in a direction away from the anode terminal 15. A base of each pnp transistor 41 is connected to the anode side of the corresponding LED string 11*a*, 11*b* via a resistor 44. A diode 43 is connected in the forward direction between the emitter terminal of the transistor 41 and the anode side of the same LED string. The transistor 41 is driven by way of the resistor 44 additionally connected to the anode side of the corresponding LED string 11*a*, 11*b*.

An emitter of each npn transistor 42 is connected to that line section 17*a*, 17*b* of the cathode terminal line 17 which leads from the transistor 42 in the direction towards the cathode terminal 18. A collector of each npn transistor 42 is connected to that line section 17*b*, 17*c* of the cathode terminal line 17 which leads from the transistor 42 in a direction away from the cathode terminal 18. A base of each npn transistor 42 is connected to the cathode side of the corresponding LED string 11*b*, 11*c* via a resistor 44. A diode 43 is connected in the forward direction between the cathode side of the corresponding LED string 11*b*, 11*c* and the emitter terminal of the transistor 42, which is driven by way of the resistor 44 additionally connected to the cathode side of the same LED string.

For voltage balancing, a respective diode 43 is also connected between the cathode side of the LED string 11*a* and the cathode terminal line 17 and between the anode side of the LED string 11*c* and the anode terminal line 14.

Consequently, each LED string 11*a*, 11*b*, 11*c* is connected in series with two diodes 43, arranged in the forward direction, between the anode terminal line 14 and the cathode terminal line 17. In this case, the diodes 43 perform the function of feeding current to the LED strings 11*a*, 11*b*, 11*c*. However, they also serve for monitoring the operating current of the LED strings 11*a*, 11*b*, 11*c*.

During normal operation of the circuit arrangement 40, an operating current flows through each LED string 11*a*, 11*b*, 11*c*. Said operating current generates at the diodes 43 a voltage drop corresponding to a forward voltage of the diodes 43. Said forward voltage and the resistance value of the resistor 44 are chosen such that the base current flowing into the corresponding transistor is high enough to reliably turn on the transistor, such that the latter can transfer the operating currents for the LED strings connected to the corresponding line downstream of said transistor.

If one LED string fails and acquires high impedance, an operating current no longer flows through it. Consequently, the forward voltage is also no longer dropped across the assigned diodes. As a result, the base current flowing into the corresponding transistors becomes so low that the latter turn off and isolate from one another the line sections connected to them. As described above with reference to FIG. 1, the supply of current to the other LED strings is interrupted as a result because none of the remaining LED strings anymore is connected both to the anode terminal 15 and to the cathode terminal 18. It is thus possible to achieve the same effects with the circuit arrangement 40 as with the circuit arrangement 10. An advantage over the circuit arrangement 30*a* shown in FIG. 3A is that the losses caused by the operating current of the LED strings in the monitoring elements (there Zener diodes 33, here diodes 43) are lower.

The bipolar transistors 41, 42 can also be embodied as Darlington transistors. In this case, two diodes 43 connected in series should respectively be used as current monitoring elements since otherwise a control voltage high enough for switching the Darlington transistors is not generated.

Not only for the purpose of increasing the luminous efficiency of the module under consideration but also for the purpose of better driving of the bipolar transistors 41, 42, in the circuit arrangement 40 the diodes 43 can likewise be embodied as light-emitting diodes (not illustrated in FIG. 4). The light-emitting diodes can be embodied in accordance with the described light-emitting diodes 12 used in the LED strings (11*a*, 11*b*, 11*c*). The forward voltage of the light-emitting diodes is higher by factors than that of the diodes which do not emit light (as illustrated in FIG. 4). The technical requirements for driving said Darlington transistors are thus satisfied. As a result, the driving of normal bipolar transistors, too, becomes significantly more robust and primarily less dependent on their own tolerances and on those of the diodes 43 because more voltage can be dropped across the resistors 44, and the latter can thus be dimensioned with significantly higher resistances. Consequently, the control current for the bipolar transistors 41, 42 is set substantially by way of the value of the resistors 44. In the case of diodes which do not emit light and which have a forward voltage similar to a base-emitter saturation voltage, the dominant factor is the very small difference—which is very susceptible to tolerances—between these two voltages (forward voltage and base-emitter saturation voltage). In order nevertheless still to generate enough control current therefrom, in the illustrated variant with diodes 43 which do not emit light, the resistors 44 must be designed with relatively low impedances, as a result of which they can scarcely still act as current limiters.

Each of the circuit arrangements 10-40 described above can be fixedly integrated in an LED luminaire. However, it can also be formed as an LED module and be inserted into an LED luminaire, wherein the module is electrically connected to a driver provided in the LED luminaire in each case via the anode terminal and the cathode terminal. An LED luminaire thus formed can include one or a plurality of such LED modules. In a further alternative, the individual LED strings can be formed as LED modules, wherein the circuit arrangement with the switching elements is arranged in the LED luminaire and the LED modules are connected to the respective switching elements by insertion into the luminaire.

LIST OF REFERENCE SIGNS

Circuit arrangement 10, 20, 30*a*, 30*b*, 40
LED string 11*a-c*
Light-emitting diode, LED 12
First switching element 13
Anode terminal line 14
Line section 14*a-c*,
Anode terminal 15
Second switching element 16
Cathode terminal line 17
Line section 17*a*-17*c*
Cathode terminal 18
pnp transistor 21
npn transistor 22
Diode 23
p-channel MOSFET 31
n-channel MOSFET 32
Zener diode 33
Light-emitting diode or series circuit of light-emitting diodes 34
pnp transistor 41
npn transistor 42
Diode or light-emitting diode 43
Resistor 44

What is claimed is:

1. A circuit arrangement for an LED luminaire, comprising:

a plurality of LED strings, each of which comprises one light-emitting diode or a plurality of light-emitting diodes connected in series with one another, an anode terminal line for connecting the plurality of LED strings to an anode terminal, a cathode terminal line for connecting the plurality of LED strings to a cathode terminal, a plurality of first switching elements, which are connected in series into the anode terminal line and subdivided into individual line sections, and a plurality of second switching elements, which are connected in series into the cathode terminal line and subdivided into individual line sections, wherein each of the LED strings is connected to the anode terminal line via one of the first switching elements and/or is connected to the cathode terminal line via one of the second switching elements, wherein each of the plurality of first switching elements and the plurality of second switching elements is connected to an LED string of the plurality of LED strings and is configured to feed an operating current to the LED string of the plurality of LED strings, electrically connect two of the individual line sections to one another if current flowing through the LED string of the plurality of LED strings exceeds a predetermined value, and to electrically isolate two of the individual line sections from one another if current flowing through the LED string of the plurality of LED strings falls below a predetermined value.

2. The circuit arrangement according to claim 1, wherein the LED strings are connected to the anode terminal line in a first order extending from the anode terminal, and the LED strings are connected to the cathode terminal line in a second order, which is the inverse of the first order, extending from the cathode terminal.

3. The circuit arrangement according to claim 1, wherein a LED string which is connected to the anode terminal line the furthest away from the anode terminal is connected to the anode terminal line without a first switching element, and/or a LED string which is connected to the cathode terminal line the furthest away from the cathode terminal is connected to the cathode terminal line without a second switching element, and/or each LED string that is neither connected to the anode terminal line the furthest away from the anode terminal nor connected to the cathode terminal line furthest away from the cathode terminal is both connected to the anode terminal line via a first switching element and connected to the cathode terminal line via a second switching element.

4. The circuit arrangement according to claim 1, wherein each of the first and second switching elements contains a bipolar transistor, wherein the bipolar transistor of each first switching element is a pnp transistor and/or the bipolar transistor of each second switching element is an npn transistor.

5. The circuit arrangement according to claim 4, wherein in the bipolar transistor of the first switching element, an emitter is connected to the line section of the anode terminal line which leads from the bipolar transistor in the direction toward the anode terminal, a collector is connected to the line section of the anode terminal line which leads from the bipolar transistor in a direction away from the anode terminal, and a base is connected to the corresponding LED string, and/or in the bipolar transistor of the second switching element, an emitter is connected to the line section of the cathode terminal line which leads from the bipolar transistor in the direction towards the cathode terminal, a collector is connected to the line section of the cathode terminal line which leads from the bipolar transistor in a direction away from the cathode terminal, and a base is connected to the corresponding LED string.

6. The circuit arrangement according to claim 4, wherein a diode path is connected in series with an LED string, which is connected to the anode terminal line or the cathode terminal line without the interposition of a first or second switching element, wherein the diode path is formed as a base-emitter path of a bipolar transistor whose collector is left unconnected.

7. The circuit arrangement according to claim 1, wherein each of the first and second switching elements comprises a field effect transistor, wherein the field effect transistor of each first switching element is preferably a p-channel MOSFET and/or the field effect transistor of each second switching element is preferably an n-channel MOSFET.

8. The circuit arrangement according to claim 7, wherein in the field effect transistor of the first switching element, a source is connected to the line section of the anode terminal line that leads from the field effect transistor in the direction toward the anode terminal, a drain is connected to the line section of the anode terminal line that leads from the field effect transistor in a direction away from the anode terminal, a gate is connected to the corresponding LED string, wherein furthermore a Zener diode is connected to the gate via an anode of the Zener diode and to the source via a cathode of the Zener diode and/or one light-emitting diode or a plurality of light-emitting diodes connected in series with one another is/are connected to the gate at a cathode side of the one light-emitting diode or a plurality of light-emitting diodes and to the source at an anode side of the one light-emitting diode or a plurality of light-emitting diodes, and/or in the field effect transistor of the second switching element, a source is connected to the line section of the cathode terminal line that leads from the field effect transistor in the direction towards the cathode terminal, a drain is connected to the line section of the cathode terminal line which leads from the field effect transistor in a direction away from the cathode terminal, a gate is connected to the corresponding LED string, and a Zener diode is connected to the gate via a cathode of the Zener diode and to the source via an anode of the Zener diode and/or one light-emitting diode or a plurality of light-emitting diodes connected in series with one another is/are connected to the gate at an anode side of the one light-emitting diode or a plurality of light-emitting diodes and to the source at a cathode side of the one light-emitting diode or a plurality of light-emitting diodes.

9. The circuit arrangement according to claim 7, wherein a Zener diode and/or one light-emitting diode or a plurality of light-emitting diodes connected in series with one another are/is connected in series between the LED string that is connected to the cathode terminal line without the interposition of a second switching element and the cathode terminal line, and/or a Zener diode and/or one light-emitting diode or a plurality of light-emitting diodes connected in series with one another are/is connected in series between the LED string which is connected to the anode terminal line without the interposition of a first switching element and the anode terminal line, and/or a Zener voltage of each Zener diode is a few tenths of a volt greater than a forward voltage or sum of the forward voltages of the light-emitting diode or the plurality of light-emitting diodes connected in series with one another that is/are connected in antiparallel with the Zener diode.

10. The circuit arrangement according to claim 4, wherein in the bipolar transistor of the first switching element, an emitter is connected to the line section of the anode terminal line which leads from the bipolar transistor in the direction towards the anode terminal, a collector is connected to the line section of the anode terminal line which leads from the bipolar transistor in a direction away from the anode terminal, a base is connected to the corresponding LED string via a resistor, and a diode is connected in the forward direction between the anode terminal line and the corresponding LED string, and/or in the bipolar transistor of the second switching element an emitter is connected to the line section of the cathode terminal line which leads from the bipolar transistor in the direction towards the cathode terminal, a collector is connected to the line section of the cathode terminal line which leads from the bipolar transistor in a direction away from the cathode terminal, a base is connected to the corresponding LED string via a resistor, and a diode is connected in the forward direction between the cathode side of the corresponding LED string and the cathode terminal line.

11. The circuit arrangement according to claim 10, wherein a diode is connected in the forward direction between the LED string that is connected to the cathode terminal line without the interposition of a second switching element and the cathode terminal line, and/or a diode is connected in the forward direction between the LED string that is connected to the anode terminal line without the interposition of a first switching element and the anode terminal line.

12. The circuit arrangement according to claim 10, wherein the bipolar transistors are embodied as Darlington transistors and in each case two diodes are connected in series between an LED string and the anode terminal line and between the LED string and the cathode terminal line.

13. The circuit arrangement according to claim 10, wherein one diode or a series circuit comprising two diodes is embodied as a light-emitting diode.

14. A LED module for insertion into an LED luminaire, comprising at least one circuit arrangement according to claim 1.

15. A LED luminaire, comprising at least one circuit arrangement according to claim 1 and a driver, connected to the anode terminal and the cathode terminal of the circuit arrangement, for feeding a voltage or a current to the circuit arrangement.

16. A LED luminaire, comprising at least one circuit arrangement according to claim 14, and a driver, connected to the anode terminal and the cathode terminal of the circuit arrangement, for feeding a voltage or a current to the circuit arrangement.

17. A LED luminaire, comprising at least one circuit arrangement according to claim 1 and an LED module according to claim 14, and a driver, connected to the anode terminal and the cathode terminal of the circuit arrangement, for feeding a voltage or a current to the circuit arrangement.

18. A LED luminaire according to claim 15, wherein the driver is a constant-current driver.

* * * * *